US009116494B2

(12) United States Patent
Tokuda

(10) Patent No.: US 9,116,494 B2
(45) Date of Patent: Aug. 25, 2015

(54) FIXING DEVICE HAVING A FUSER PAD OF VARYING THICKNESS AND IMAGE FORMING APPARATUS INCORPORATING SAME

(71) Applicant: Tetsuo Tokuda, Kanagawa (JP)

(72) Inventor: Tetsuo Tokuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/908,213

(22) Filed: Jun. 3, 2013

(65) Prior Publication Data

US 2013/0330111 A1 Dec. 12, 2013

(30) Foreign Application Priority Data

Jun. 6, 2012 (JP) ..... 2012-128603
May 20, 2013 (JP) ..... 2013-105849

(51) Int. Cl.
*G03G 15/20* (2006.01)
*G03G 15/00* (2006.01)

(52) U.S. Cl.
CPC ..... *G03G 15/6576* (2013.01); *G03G 15/2053* (2013.01); *G03G 2215/2035* (2013.01)

(58) Field of Classification Search
CPC ..... G03G 15/6576; G03G 15/20; G03G 25/2032; G03G 15/2028; G03G 15/2089; G03G 2215/2009; G03G 2215/20; G03G 2215/2005; G03G 2215/2061
USPC ..... 399/328–333
See application file for complete search history.

(56) References Cited

U.S. PATENT DOCUMENTS

| | | | | |
|---|---|---|---|---|
| 5,091,752 | A | 2/1992 | Okada | |
| 2005/0254866 | A1* | 11/2005 | Obata et al. | 399/328 |
| 2006/0088350 | A1 | 4/2006 | Imamiya | |
| 2008/0101825 | A1* | 5/2008 | Sato | 399/322 |
| 2008/0298862 | A1 | 12/2008 | Shinshi | |
| 2009/0116885 | A1* | 5/2009 | Ando | 399/329 |
| 2010/0316421 | A1* | 12/2010 | Komuro | 399/329 |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052282 | A1 | 3/2011 | Shinshi et al. | |

(Continued)

FOREIGN PATENT DOCUMENTS

| | | | |
|---|---|---|---|
| CN | 101430531 | A | 5/2009 |
| CN | 102467045 | A | 5/2012 |

(Continued)

*Primary Examiner* — Benjamin Schmitt
*Assistant Examiner* — Matthew Miller
(74) *Attorney, Agent, or Firm* — Harness, Dickey & Pierce, P.L.C.

(57) ABSTRACT

A fixing device includes a rotatable, flexible fuser belt, a fuser pad, and a pressure member. The rotatable, flexible fuser belt is looped into a generally cylindrical configuration. The fuser pad extends in an axial, longitudinal direction thereof inside the loop of the fuser belt. The pressure member extends in the axial direction opposite the fuser pad with the fuser belt interposed between the fuser pad and the pressure member. The pressure member presses against the fuser pad through the fuser belt in a load direction to form a fixing nip therebetween, through which a recording medium is conveyed in a conveyance direction. The fuser pad includes an upstream section, a midstream section, and a downstream section having differing thicknesses is a load direction arranged in series from upstream to downstream in the conveyance direction.

17 Claims, 8 Drawing Sheets

(56) References Cited

U.S. PATENT DOCUMENTS

| | | | | |
|---|---|---|---|---|
| 2011/0058862 | A1 | 3/2011 | Yamaguchi et al. | |
| 2011/0058863 | A1 | 3/2011 | Shinshi et al. | |
| 2011/0058865 | A1 | 3/2011 | Tokuda et al. | |
| 2011/0058866 | A1 | 3/2011 | Ishii et al. | |
| 2011/0064443 | A1 | 3/2011 | Iwaya et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0170917 | A1 | 7/2011 | Yoshikawa et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229181 | A1 | 9/2011 | Iwaya et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2012/0051774 | A1 | 3/2012 | Ikebuchi et al. | |
| 2012/0114345 | A1 | 5/2012 | Fujimoto et al. | |
| 2012/0121303 | A1 | 5/2012 | Takagi et al. | |
| 2012/0121304 | A1* | 5/2012 | Tokuda et al. | 399/329 |
| 2012/0121305 | A1 | 5/2012 | Yoshikawa et al. | |
| 2012/0148303 | A1 | 6/2012 | Yamaguchi et al. | |
| 2012/0155935 | A1* | 6/2012 | Yoshikawa et al. | 399/329 |
| 2012/0155936 | A1* | 6/2012 | Yamaguchi et al. | 399/329 |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1* | 7/2012 | Imada et al. | 399/329 |
| 2012/0224878 | A1 | 9/2012 | Ikebuchi et al. | |
| 2012/0237273 | A1 | 9/2012 | Yoshinaga et al. | |
| 2013/0045032 | A1 | 2/2013 | Shimokawa et al. | |
| 2013/0142551 | A1 | 6/2013 | Yamano et al. | |
| 2014/0186079 | A1* | 7/2014 | Morita | 399/329 |

FOREIGN PATENT DOCUMENTS

| | | |
|---|---|---|
| JP | 2003-215953 | 7/2003 |
| JP | 2009-003410 | 1/2009 |
| JP | 2012-103609 | 5/2012 |

* cited by examiner

FIXING DEVICE HAVING A FUSER PAD OF VARYING THICKNESS AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application Nos. 2012-128603 and 2013-105849, filed on Jun. 6, 2012 and May 20, 2013, respectively, each of which is hereby incorporated by reference herein in its entirety.

BACKGROUND

1. Technical Field

The present invention relates to a fixing device and an image forming apparatus incorporating the same, and more particularly, to a fixing device that employs a belt for fixing images, and an image forming apparatus incorporating such a fixing device.

2. Background Art

In electrophotographic image formation, an image is formed by attracting toner particles to an electrostatic latent image on a photoconductive surface for subsequent transfer to a recording medium such as a sheet of paper. After transfer, the imaging process is followed by a fixing process using a fixing device, which permanently fixes the toner image in place on the recording medium to obtain a print output.

One specific type of the fixing device is a roller-based fixing device employing a pair of cylindrical fixing rollers, one being a fuser roller subjected to heating, and the other being a pressure roller disposed opposite the fuser roller. The pressure roller presses against the fuser roller to form a fixing nip therebetween, through which the recording sheet is conveyed. At the fixing nip, the fuser roller heats the incoming sheet to fuse and melt the toner particles, while the pressure roller presses the sheet against the fuser roller to cause the molten toner to set onto the sheet surface.

Another, more thermally efficient fixing device employs a flexible, looped fuser belt, instead of the fuser roller, subjected to heating and disposed opposite the pressure roller. Compared to the roller-based configuration, the belt-based fixing device does not require significant time to heat the fuser assembly to an operational temperature upon start-up, owing to a relatively low heat capacity of the fuser belt lower than that of the fuser roller.

FIG. 1 is an axial, cross-sectional view of an exemplary belt-based fixing device 120.

As shown in FIG. 1, the fixing device 120 includes a fuser belt 121 looped into a generally cylindrical configuration, a fuser pad 126 disposed inside the loop of the belt 121, and a pressure roller 131 pressing against the fuser pad 126 via the belt 121 to form a fixing nip N therebetween. Also included is a stationary, tubular pipe 122, formed of metal or heat conductive material, around which the fuser belt 121 is supported or guided during rotation. A heater 125 is disposed inside the tubular pipe 122 to radiate heat to the pipe 122, which in turn conducts heat to the fuser belt 121 entrained around the pipe 122.

One problem associated with the belt-based fixing device is that the recording medium, in particular, a sheet of paper that contains relatively large amount of moisture, curls or bends toward the fuser belt in a manner similar to that of a bimetallic strip. Such curling causes the recording sheet to eventually wind or wrap around the fuser belt upon exiting the fixing nip, leading to malfunction or even failure of the fixing process.

To counteract the problem, a technique has been proposed that employs an anti-curling member downstream from the fixing nip to prevent curling and concomitant winding of the recording sheet around the fuser belt.

According to this method, the fuser belt comprises a looped film supported around a guide member within which a heater is accommodated. The anti-curling member is a protrusion formed integral with the guide member, which contacts the recording sheet upon exiting the fixing nip, so that the outgoing sheet moves away from the fuser belt. Disposed downstream from the anti-curling member is a sheet stripper, which defines a longitudinal edge adjacent to and out of contact with the fuser belt to engage the leading edge of the recording sheet for separating it away from the fuser belt.

BRIEF SUMMARY

Exemplary aspects of the present invention are put forward in view of the above-described circumstances, and provide a novel fixing device.

In one exemplary embodiment, the fixing device includes a rotatable, flexible fuser belt, a fuser pad, and a pressure member. The rotatable, flexible fuser belt is looped into a generally cylindrical configuration. The fuser pad extends in an axial, longitudinal direction thereof inside the loop of the fuser belt. The pressure member extends in the axial direction opposite the fuser pad with the fuser belt interposed between the fuser pad and the pressure member. The pressure member presses against the fuser pad through the fuser belt in a load direction to form a fixing nip therebetween, through which a recording medium is conveyed in a conveyance direction. The fuser pad includes an upstream section, a midstream section, and a downstream section arranged in series from upstream to downstream in the conveyance direction. The upstream section defines a generally planar surface along which the recording medium is introduced into the fixing nip. The midstream section defines an inwardly curved, concave surface that conforms to an outer circumferential surface of the pressure member. The downstream section defines a protruding surface that protrudes outward toward the pressure member while located apart from the pressure member. The pressure member comprises a concave roller whose diameter gradually increases by a first amount of taper from a longitudinal center toward both longitudinal ends thereof in the axial direction. The downstream section of the fuser pad has a thickness in the load direction which gradually increases by a second amount of taper, corresponding to the first amount of taper, from a longitudinal center toward both longitudinal ends thereof in the axial direction.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
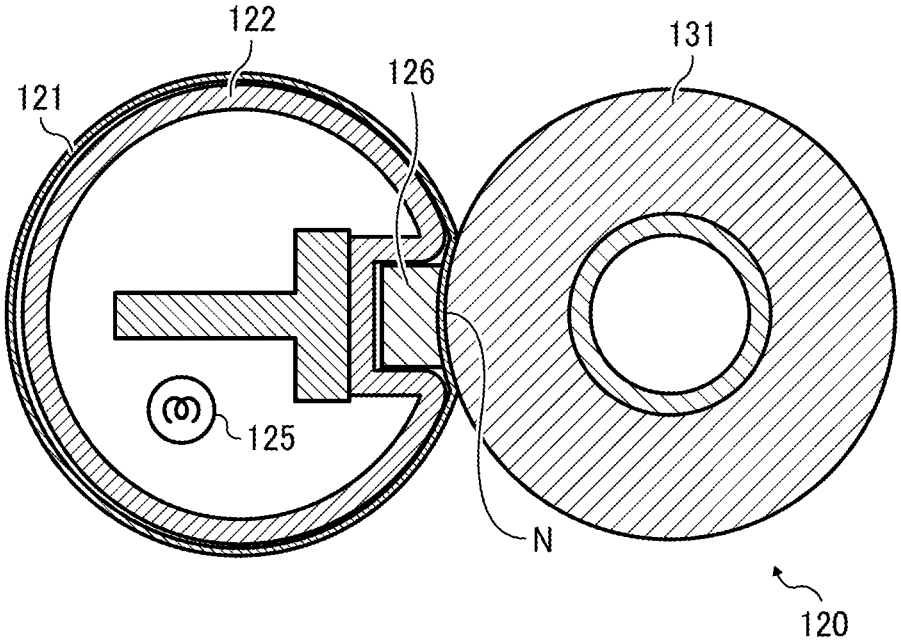
FIG. 1 BACKGROUND ART
FIG. 1 is an axial, cross-sectional view of an exemplary belt-based fixing device.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
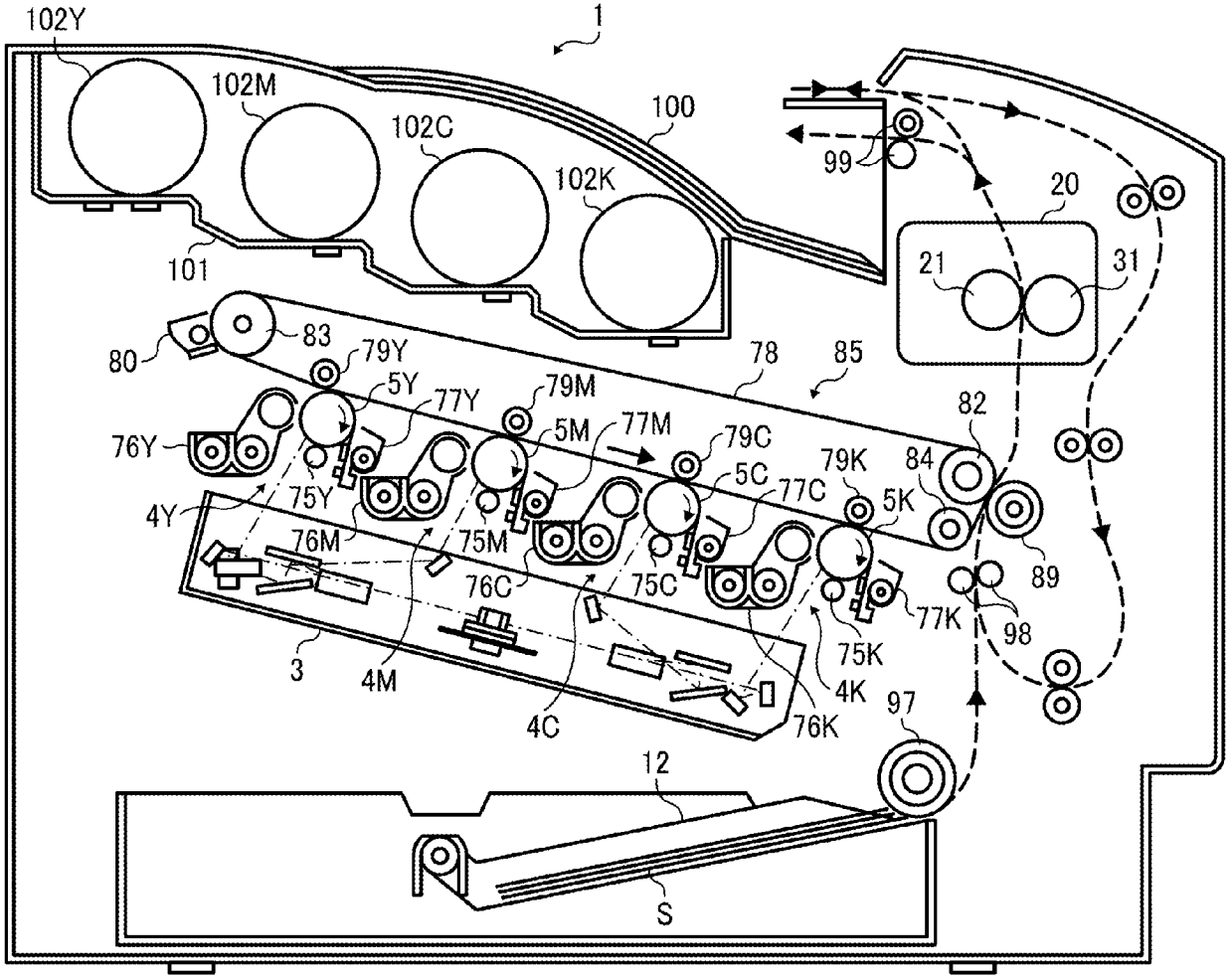
FIG. 2 schematically illustrates an image forming apparatus according to one embodiment of this patent specification.

FIG. 2 schematically illustrates an image forming apparatus 1 according to one embodiment of this patent specification.

As shown in FIG. 2, the image forming apparatus 1 is a tandem color printer including four imaging stations 4Y, 4M, 4C, and 4K arranged in series along the length of an intermediate transfer unit 85 to form a toner image of a particular primary color, as designated by the suffixes "Y" for yellow, "M" for magenta, "C" for cyan, and "K" for black, on a recording medium such as a sheet of paper S. A bottle rack 101 is provided in the upper portion of the apparatus 1, accommodating four removable toner bottles 102Y, 102M, 102C, and 102K therein from which toner is supplied to the imaging stations 4Y, 4M, 4C, and 4K, respectively.

Each imaging station (indicated collectively by the reference numeral 4) includes a motor-driven, cylindrical photoconductor drum 5 having its outer, photoconductive surface surrounded by a charging device 75, a development device 76, a cleaning device 77, and a discharging device, while subjected to light radiation from an exposure device 3. In the present embodiment, the charging device 75 comprises a contact charger disposed in contact with the photoconductor drum 5. The development device 76 comprises a non-contact development device disposed out of contact with the photoconductor drum 5. The cleaning device 77 comprises a brush or blade held in contact with the photoconductor drum 5.

The intermediate transfer unit 85 includes an intermediate transfer belt 78 entrained around a transfer backup roller 82, a cleaning backup roller 83, and a tension roller 84. In the present embodiment, the intermediate transfer belt 78 comprises an endless looped belt formed of a substrate of resin film or rubber.

A rotary driver may be provided to the transfer backup roller 82, which imparts torque to the roller 82 to in turn rotate the belt 78 around the belt supporting rollers. Four primary transfer rollers 79Y, 79M, 79C, and 79K are disposed opposite the photoconductor drums 5Y, 5M, 5C, and 5K, respectively, via the belt 78 to form four primary transfer nips therebetween. A secondary transfer roller 89 is disposed opposite the transfer backup roller 82 via the belt 78 to form a secondary transfer nip therebetween. Opposite the cleaning backup roller 83 is a belt cleaner 80 for cleaning the belt surface upstream from the primary transfer nips and downstream from the secondary transfer nip.

Disposed adjacent to the intermediate transfer unit 85 is a fixing device 20, which includes a fuser member 21 and a pressure member 31, one being heated and the other being pressed against the heated one, to form a fixing nip therebetween. A detailed description of the fixing device 20 and its associated structure will be given later with reference to FIG. 3 and subsequent drawings.

At the bottom of the apparatus 1 lies an input sheet tray 12 for accommodating a stack of recording sheets S, with a feed roller 97 disposed at the outlet of the tray 12 to pick up a recording sheet S from the sheet stack. A pair of registration rollers 98, a pair of discharge rollers 99, and other conveyance and guide members together define a sheet conveyance path along which the recording sheet S advances upward toward the intermediate transfer unit 85 and then through the fixing device 20 to finally reach an output sheet tray 100 situated atop the apparatus 1.

During operation, the photoconductor drum 5 in each imaging station rotates clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75, followed by the exposure device 3 irradiating the photoconductive surface with a modulated laser beam. The laser exposure selectively dissipates the charge on the photoconductive surface to form an electrostatic latent image thereon according to image data obtained, for example, by scanning an original document or transmitted from an external data source through a network. Then, the latent image is rendered visible through the development device 76. The toner image thus obtained is forwarded to the primary transfer nip between the primary transfer roller 79 and the photoconductor drum 5.

At the primary transfer nip, the primary transfer roller 79 is supplied with a bias voltage of a polarity opposite that of the toner on the photoconductor drum 5. This electrostatically transfers the toner image from the photoconductive surface to an outer surface of the intermediate transfer belt 78, with a certain small amount of residual toner particles left on the photoconductive surface. As the belt 78 rotates counterclockwise in the drawing, such transfer process occurs sequentially at the four primary transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner mechanically with the cleaning brush or blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip.

Thereafter, the recording sheet S is forwarded by the discharge rollers 99 to the output tray 100 for stacking outside the apparatus body, which completes one operational cycle of the image forming apparatus 1.

Operation of the image forming apparatus 1 may be governed by a system controller, such as a microcomputer including a central processing unit (CPU) combined with a read-only memory (ROM) that stores programs for execution by the CPU, as well as other volatile or non-volatile data storage, such as a random-access memory (RAM) and input/output interface software.

The system controller may be connected with various actuator devices involved in the electrophotographic imaging processes, such as rotary motors or actuators driving the photoconductive drums 5 of the imaging station 4 and the pressure member 31 of the fixing unit 20, and a power supply for a heater included in the thermal fixing process, as well as various sensors that detect, for example, changes in operational conditions to output detection signals, based on which the controller controls operation of the actuator devices.

An operation panel including various input/output devices, such as keys, buttons, and display monitors, is provided in the image forming apparatus 1 to allow the system controller to communicate information to and from a human operator manipulating the operation panel.

The image forming apparatus 1 described above may be configured as any type of electrophotographic imaging system, such as a photocopier, facsimile machine, printer, plotter, or multifunctional machine incorporating several of those imaging functions. For example, where the image forming apparatus 1 includes a facsimile capability, a dedicated, facsimile output sheet tray may be provided for stacking a recording sheet on which a telecommunicated image is printed according to a facsimile signal sent via a telephone line.

Figure 3:
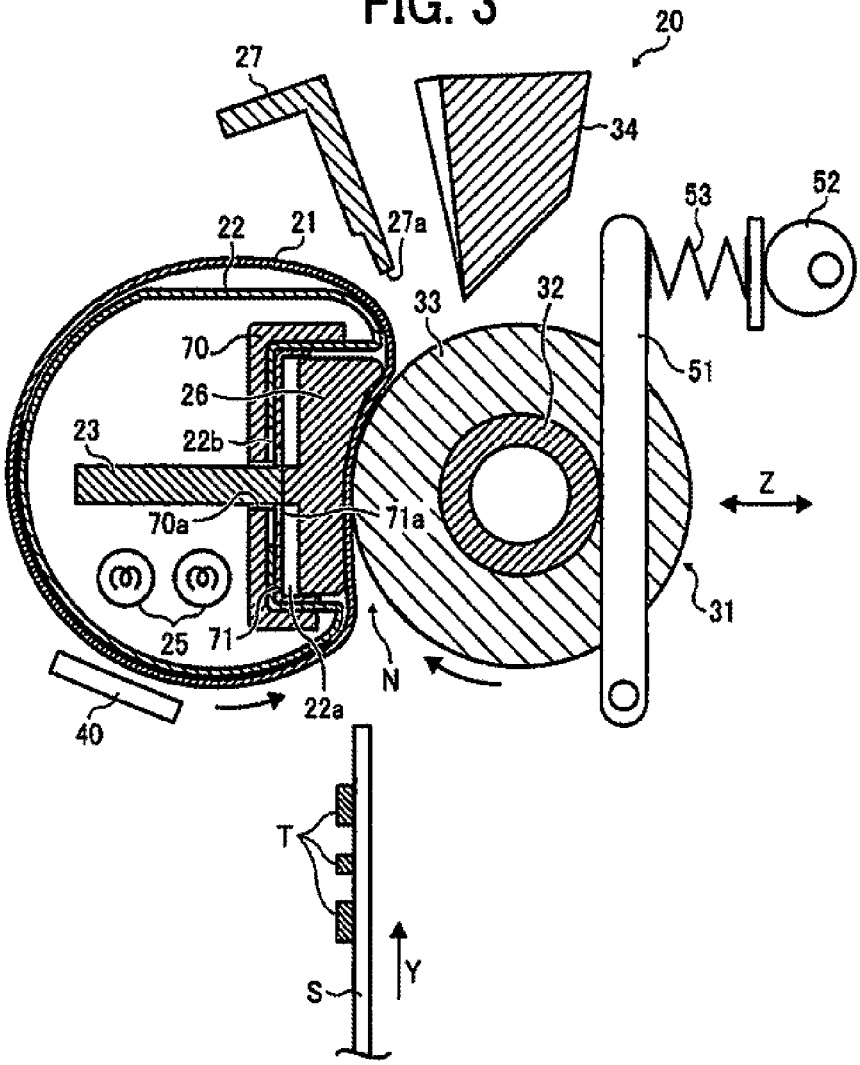
FIG. 3 is an end-on, axial view of a fixing device according to one embodiment of this patent specification.
Figure 4:
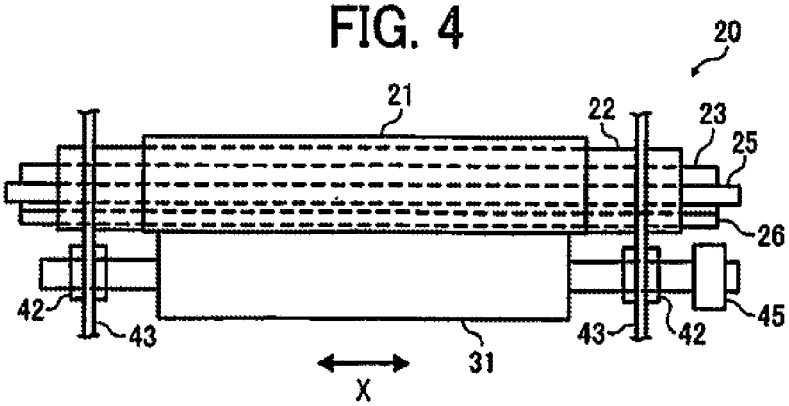
FIG. 4 is a top plan view of the fixing device of FIG. 3.

FIGS. 3 and 4 are an end-on, axial view and a top plan view, respectively, of the fixing device 20 incorporated in the image forming apparatus 1 according to one embodiment of this patent specification.

As shown in FIGS. 3 and 4, the fixing device 20 includes a rotatable, flexible fuser belt 21 looped into a generally cylindrical configuration, a fuser pad 26 extending in an axial, longitudinal direction X thereof inside the loop of the fuser belt 21, and a pressure member 31 extending in the axial direction X opposite the fuser pad 26 with the fuser belt 21 interposed between the fuser pad 26 and the pressure member 31. The pressure member 31 presses against the fuser pad 26 through the fuser belt 21 in a load direction Z to form a fixing nip N therebetween, through which a recording medium S is conveyed in a conveyance direction Y.

The pressure member 31 is equipped with an adjustable biasing mechanism, including, for example, a positioning lever 51, a cam 52, and an elastic member 53, which allows positioning the pressure member 31 relative to the fuser belt 21 in the load direction Z to establish the fixing nip N with a desired strength or width in the conveyance direction Y, and to de-establish the fixing nip N where no nip pressure is required. A rotary driver is connected to a shaft of the pressure member 31 via a gear 45 through which torque is imparted to the pressure member 31.

Also included in the fixing device 20 are a generally cylindrical, tubular heat pipe 22 around which the fuser belt 21 is entrained, a reinforcing member 23 inside the loop of the fuser belt 21 to reinforce the fuser pad 26, and one or more heaters 25 disposed adjacent to the fuser belt 21 to heat the belt 21. A pair of inner and outer, retaining stays 70 and 71 are disposed in engagement with the heat pipe 22 to retain the pipe 22 in shape. A temperature sensor 40, such as a thermometer or a thermistor, is disposed adjacent to the fuser belt 21 to detect a temperature at an outer surface of the belt 21.

With specific reference to FIG. 4, the fuser belt 21 and the pressure member 31 are shown extending parallel to each other in the axial, longitudinal direction X between a pair of sidewalls 43. Components disposed inside the loop of the fuser belt 21, including the heat pipe 22, the reinforcing member 23, the heater 25, and the fuser pad 26, also extend generally parallel to each other in the axial direction X.

During operation, the pressure member 31 rotates clockwise in the drawing to in turn cause the fuser belt 21 to rotate counterclockwise in the drawing. Meanwhile, the power circuitry starts supplying electricity to the heater 25, which then generates heat for conduction to the heat pipe 22 to in turn heat the fuser belt 21. Power supply to the heater 25 is adjusted according to readings of the temperature sensor 40 to heat the fixing nip N to a given operational temperature.

Then, a recording sheet S bearing an unfixed, powder toner image T enters the fixing device 20 with its front, printed face brought into contact with the fuser belt 21 and bottom face into contact with the pressure member 31. As the fuser belt 21 and the pressure member 31 rotate together, the recording sheet S moves in the conveyance direction Y through the fixing nip N, where the fuser belt 21 heats the incoming sheet S to fuse and melt the toner particles, while the pressure member 31 presses the sheet S against the fuser pad 26 to cause the molten toner to set onto the sheet surface.

The heat pipe 22 is heated directly through radiation from the heater 25, so that the fuser belt 21 rotating around the heat pipe 22 is heated indirectly through conduction from the heat pipe 22. Provision of the heat pipe 22 inside the loop of the fuser belt 21 allows for fast reliable fixing process with a short warm-up time and fast-print time required to execute a print job, while effectively preventing imaging defects caused due to insufficient heating of the fuser belt even where the fixing device operates at a higher processing speed. Moreover, such a heating assembly does not require a complicated structure, leading to a compact configuration of the belt-based fixing device 20.

In the present embodiment, the fuser belt 21 comprises a thin, flexible endless belt composed of a thermally conductive substrate upon which an intermediate layer of elastic material and an outer layer of release agent are deposited one upon another to form a multilayered structure, approximately 1 mm or smaller in thickness. The fuser belt 21 is looped into a generally cylindrical configuration, approximately 15 mm to approximately 120 mm in diameter, so that the outer layer faces the exterior of the loop and the substrate faces the interior of the loop. For example, the fuser belt 21 may be a looped belt having an outer diameter of approximately 30 mm in its looped, generally cylindrical configuration.

The substrate of the belt 21 may be formed of thermally conductive material, approximately 20 μm to approximately 35 μm thick, including nickel, stainless steel, or any suitable metal, as well as synthetic resin such as polyimide (PI).

The intermediate elastic layer of the belt 21 may be a deposit of rubber, such as solid or foamed silicone rubber, fluorine resin, or the like, approximately 100 μm to approximately 300 μm thick on the substrate 21*a*. The elastic layer serves to accommodate minute variations in applied pressure to maintain smoothness of the belt surface at the fixing nip N, which ensures uniform distribution of heat across a recording sheet S to yield a resulting image with a smooth, consistent appearance.

The outer coating of the belt 21 may be a deposit of a release agent, such as tetra fluoro ethylene-perfluoro alkyl vinyl ether copolymer or PFA, polytetrafluoroethylene (PTFE), polyimide (PI), polyetherimide (PEI), polyethersulfide (PES), or the like, approximately 10 to approximately 50 μm thick on the elastic layer. The coating layer provides good stripping of toner from the belt surface to ensure reliable conveyance of recording sheets S through the fixing nip N.

The one or more heaters 25 each comprises an elongated, radiant heating element, such as a halogen heater or a carbon heater, disposed stationary inside the heat pipe 22 with its opposed longitudinal ends secured to the sidewalls 43 to radiate heat to an inner circumferential surface of the heat pipe 22. The heater 25 may operate under control of the system controller, which adjusts power supply to the heater 25 to provide adequate radiation to the heat pipe 22.

The heat pipe 22 comprises a thin-walled pipe formed of thermally conductive material, such as aluminum, iron, stainless steel, or any suitable metal, disposed stationary inside the loop of the fuser belt 21 with its opposed longitudinal ends secured to the sidewalls 43 to face the inner circumferential surface of the fuser belt 21 except at the fixing nip N. Mounting of the heat pipe 22 may be accomplished, for example, using a pair of mounting flanges formed of suitable material, such as resin, provided to the respective longitudinal ends of the heat pipe 22.

Optionally, the inner circumferential surface of the heat pipe 22 may be coated with a black, thermally absorptive material to increase emissivity of the heat pipe 22. Such arrangement allows for obtaining high thermal efficiency in heating the fuser belt 21 with the radiant heater 25.

On one side of the heat pipe 22 (i.e., the side facing the pressure member 31) is a longitudinal side slot 22*a* into which the fuser pad 26 is inserted with a suitable clearance between the adjoining surfaces of the heat pipe 22 and the fuser pad 26. The heat pipe 22 has an elongated opening or slit 22*b* along the side slot 22*a* such that the fuser pad 26 accommodated in the side slot 22*a* can contact the reinforcing member 23 inside the heat pipe 22 through the side slit 22*b*.

The longitudinally slotted configuration of the heat pipe 22 allows for efficient heating of the fuser belt 21 over an extended circumferential area where the fuser belt 21 contacts the heat pipe 22 subjected to heating outside the fixing nip N, in particular, upstream from the fixing nip N. Such a heat pipe 22 may be formed, for example, by bending a 0.1-mm thick stainless steel plate into a generally cylindrical configuration with its opposed two longitudinal edges bent or folded twice in the shape of a letter L to form the longitudinal side slot 22*a* and the slit 22*b* between the longitudinal edges.

Thickness of the wall of the heat pipe 22 may be set to a suitable range, for example, no more than 0.2 mm, and preferably, approximately 0.1 mm. The extremely thin-walled heat pipe 22 with a wall thickness of 0.2 mm or less can be heated quickly and sufficiently to in turn heat the fuser belt 21, leading to high thermal efficiency in the belt-based fixing device 20.

The heat pipe 22 has its outer diameter dimensioned relative to the inner diameter the fuser belt 21, so that the fuser belt 21 during rotation adjoins a heated circumferential portion (i.e., upstream from the fixing nip N in the present embodiment) of the heat pipe 22, at which the heat pipe 22 is internally subjected to radiation from the heater 25, uninterrupted by the reinforcing member 23 inside the heat pipe 22.

For example, the fuser belt 21 may be in close proximity with the heated circumferential portion of the heat pipe 22, with a gap of approximately 0.3 mm or less left between the adjoining surfaces of the belt 21 and the pipe 22. Alternatively, instead, the fuser belt 21 may establish a direct, sliding contact with the heated circumferential portion of the heat pipe 22 for obtaining higher thermal efficiency in heating the fuser belt 21. In such cases, to prevent premature abrasion or damage due to increased torque on the sliding surfaces of the belt 21 and the pipe 22, the fuser belt 21 and the heat pipe 22 is designed to contact each other with a contact pressure of approximately 0.3 kgf/cm$^2$ or smaller.

Additionally, to protect the fuser belt 21 against abrasion from contact with the heat pipe 22, a lubricating agent, such as fluorine grease, may be deposited on the outer circumferential surface of the heat pipe 22. Reducing friction between the fuse belt 21 and the heat pipe 22 may also be accomplished by forming the sliding surface of the heat pipe 22 with a material of low frictional coefficient, or providing a coating layer containing fluorine on the inner circumferential surface of the fuser belt 21.

Although the heat pipe 22 depicted in FIG. 3 is configured as a generally cylindrical body having a substantially circular cross-section, configuration of the heat pipe 22 may be other than that depicted in the present embodiment, including, for example, a hollow prismatic body having a complex, polygonal cross-section.

The reinforcing member 23 comprises an elongated piece of rigid material, such as iron, stainless steel, or any suitable metal, having a length equal to that of the fuser pad 26, with its opposed longitudinal ends secured to the sidewalls 43. Mounting of the reinforcing member 23 may be accomplished, for example, using a pair of mounting flanges, such as the one used to mount the heat pipe 22.

Figure 5:
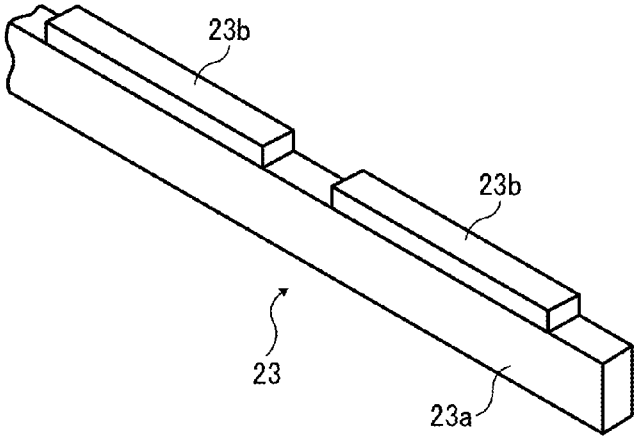
FIG. 5 is a perspective view of a reinforcing member before assembly into the fixing device of FIG. 3.

With additional reference to FIG. 5, which is a perspective view of the reinforcing member 23 before assembly into the fixing device 20, the reinforcing member 23 is shown constructed of an elongated beam 23*a* and multiple contact portions 23*b* disposed along the length of the beam 23*a* on a side that faces the fuser pad 26 upon assembly.

The reinforcing member 23 supports pressure from the pressure member 31 through the fuser pad 26 and the fuser belt 21 in the load direction Z, thereby preventing the fuser pad 26 from significant deformation under pressure at the fixing nip N. Providing the reinforcing member 23 with the multiple contact portions 23*b*, as opposed to a single contact portion, allows for equalizing pressure distribution along the length of the fuser pad 26, leading to good fixing performance with uniform nip pressure across the fixing nip N.

Optionally, the reinforcing member 23 may be at least partially provided with a covering of thermal insulator, or subjected to a bright annealing or mirror polish, where it faces the heater 25 inside the heat pipe 22. Such arrangement prevents heat from dissipation in the reinforcing member 23, and thus causes more heat to be imparted to the heat pipe 22, leading to higher thermal efficiency in heating the fuser belt 21 around the internally heated pipe 22.

Figure 6:
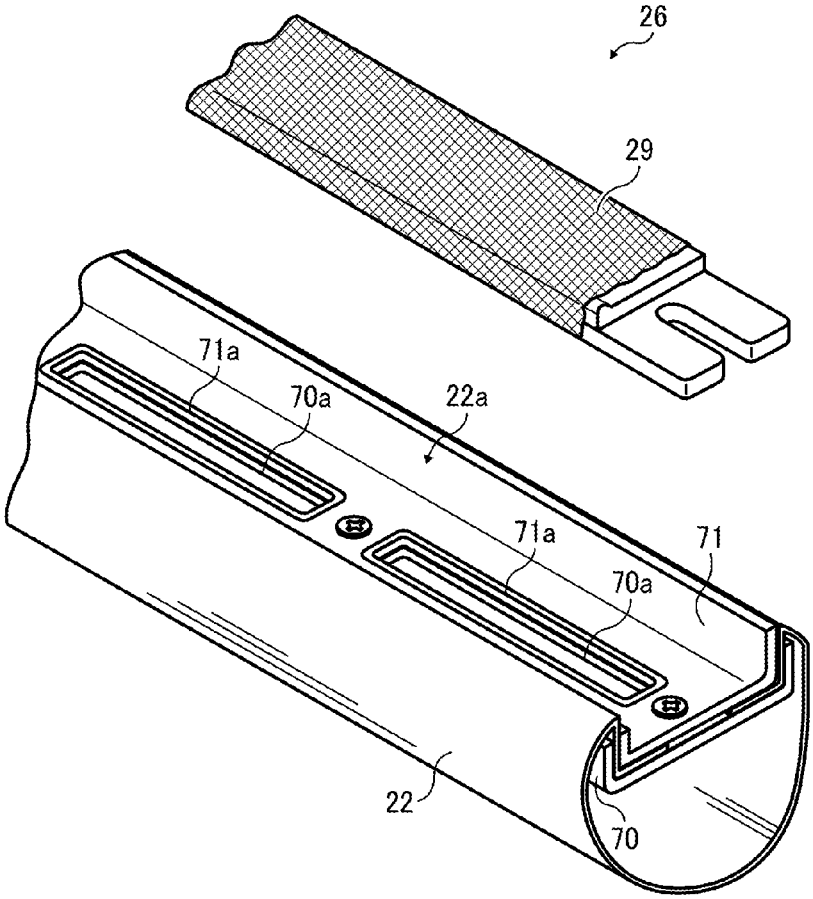
FIG. 6 is a perspective view of a heat pipe and a fuser pad before assembly into the fixing device of FIG. 3.

With additional reference to FIG. 6, which is a perspective view of the heat pipe 22 and the fuser pad 26 before assembly into the fixing device 20, the pair of inner and outer, retaining stays 70 and 71 is shown assembled with the heat pipe 22, the former fitting around the side slot 22*a* from inside the heat pipe 22, and the latter fitting around the side slot 22*a* from outside the heat pipe 22.

The inner retaining stay 70 comprises an elongated, semi-tubular piece of sheet metal having a rectangular U-shaped cross-section, formed by bending a sheet of stainless steel, approximately 1.5 mm thick. The inner retaining stay 70 may be subjected to bright annealing or mirror polish where it faces the heater assembly, which allows for efficient heating of the heat pipe 22 through radiation from the heaters 25.

The outer retaining stay 71 comprises an elongated, semi-tubular piece of sheet metal having a rectangular U-shaped cross-section. The fuser pad 26 is disposed inside the outer retaining stay 71 with a clearance left between the adjoining surfaces of the fuser pad 26 and the retaining stay 71. The outer retaining stay 71 may be formed into a box-like, closed-end configuration, instead of a semi-tubular rectangular configuration, which can effectively restrict displacement of the fuser pad 26 in the directions perpendicular to the conveyance direction Y.

During assembly, the inner and outer retaining stays 70 and 71 are disposed on the opposed L-shaped bent edges of the heat pipe 22, such as a 0.1-mm thick stainless steel plate bent into a generally cylindrical configuration, the former from inside and the latter from outside the heat pipe 22. The stays 70 and 71 are then fastened in place, for example, using screws. The heat pipe 22 thus having its opposed L-shaped bent edges clamped together can maintain its generally cylindrical configuration.

Provision of the retaining stays 70 and 71 allows for high precision and stability in the shape of the side slot 22*a* of the heat pipe 22, which in turn allows for formation of the fixing nip N in parallel alignment with the recording sheet S advanced in the conveyance direction Y so that the fuser belt 21 can closely contacts the recording sheet S throughout the fixing nip N, leading to reliable imaging performance of the fixing device 20.

Additionally, the inner retaining stay 70 may have one or more through-holes 70*a* defined where it faces the slit 22*b* of the heat pipe 22, for passing therethrough the contact portion 23*b* of the reinforcing member 23. Likewise, the outer retaining stay 71 may have one or more through-holes 71*a* defined where it faces the slit 22*b* of the heat pipe 22, for passing therethrough the contact portion 23*b* of the reinforcing member 23.

The number of the through-holes in each retaining stay is equal to that of the contact portions 23*b* of the reinforcing member 23 (e.g., five in the present embodiment), and the size of the through-holes in each retaining stay is larger than that of the contact portions 23*b*. The through-holes 70*a* and 71*a* are aligned with each other, such that each contact portion 23*b* of the reinforcing member 23 can extend through the aligned through-holes 70*a* and 71*a* to contact the fuser pad 26 in the side slot 22*a* of the heat pipe 22.

With continued reference to FIGS. 3 and 4, the pressure member 31 is shown comprising a generally cylindrical roller formed of a hollow, cylindrical core 32 of metal, covered with an elastic layer 33 of thermally insulating material, such as sponged or solid silicone rubber, fluorine rubber, or the like. An additional, thin outer layer of release agent, such as PFA, PTFE, or the like, may be deposited upon the elastic layer 33. In the present embodiment, the pressure roller 31 is approximately 30 mm in diameter.

The elastic layer 33 of the pressure roller 31 may be formed of a sponged material, such as sponged silicone rubber. Such an elastic layer 33 effectively absorbs extra pressure applied to the fuser pad 26 from the pressure roller 31, which protects the fuser pad 26 against deformation under nip pressure. The sponged elastic layer 33 also serves as an insulator that prevents heat conduction from the fuser belt 21 toward the pressure roller 31, leading to high thermal efficiency in heating the fuser belt 21 in the fixing device 20.

A pair of bearings 42 is provided to the longitudinal ends of the pressure roller 31, which rotatably holds the roller 31 in position onto the sidewalls 43 of the fixing device 20. Optionally, the pressure roller 31 may have a dedicated heater, such as a halogen heater, accommodated in the hollow interior of the metal core 32.

The fuser pad 26 comprises an elongated, substantially rectangular piece of heat-resistant elastic material, such as liquid crystal polymer (LCP), PI, polyamide-imide (PAI), disposed stationary inside the loop of the fuser belt 21 with its opposed longitudinal ends secured to the sidewalls 43 to receive pressure from the pressure member 31.

Figure 7:
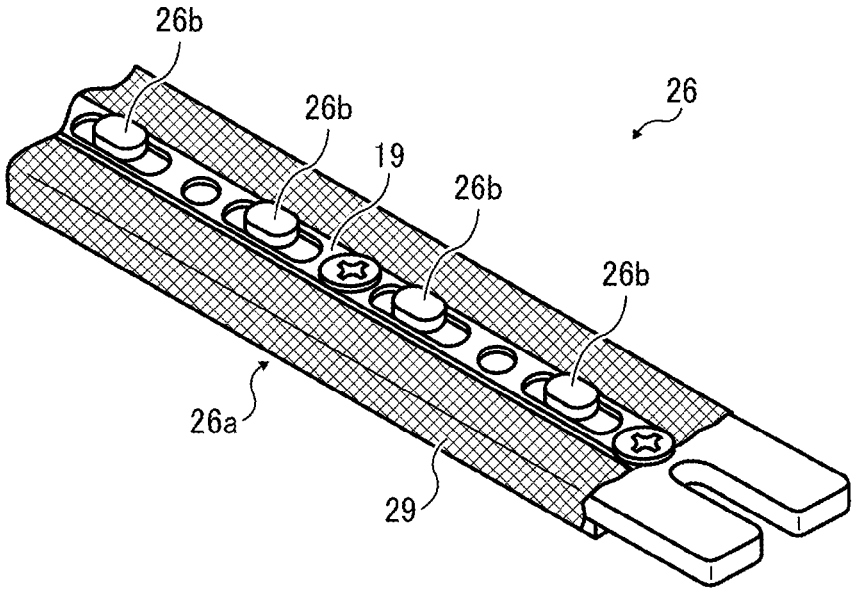
FIG. 7 is another perspective view of the fuser pad of FIG. 6.

With additional reference to FIG. 7, which is another perspective view of the fuser pad 26, the fuser pad 26 is shown including an elongated body 26*a* with one or more support projections 26*b* extending from the elongated body 26*a*.

Upon assembly, the fuser pad 26 is disposed with the elongated body 26*a* facing the pressure member 31 and the support projections 26*b* facing the reinforcing member 23. The elongated body 26*a* of the fuser pad 26 serves to receive pressure from the pressure roller 31 via the fuser belt 21 in the load direction Z. The support projections 26*b* serve to contact the contact portions 23*b* of the reinforcing member 23 extending from inside the heat pipe 22 through the slit 22*b*, such that the fuser pad 26 maintains its proper operational shape and position in the load direction Z under pressure from the pressure roller 31.

The multiple support projections 26*b* may have an identical thickness in the load direction Z. Alternatively, instead, the multiple support projections 26*b* may have different thicknesses in the load direction Z depending on the position along the length of the fuser pad 26, so that the one at the longitudinal center is the longest and those at the longitudinal ends are the shortest of all the projections 26*b*. Varying the size of the projections 26*b* allows for effectively equalizing nip pressure along the length of the fuser pad 26, leading to good fixing performance with uniform nip pressure across the fixing nip N.

Optionally, a covering 29 of anti-friction material, such as a web or mesh of PTFE fibers or fluorine-coated glass fibers, may be wound around the elongated body 26*a*, with a perforated attachment 19 fitted around the projections 26*b* and screwed onto the elongated body 26*a* to secure the covering 29 in position. Provision of the anti-friction covering 29 allows for reducing friction between the fuser pad 26 and the fuser belt 21.

With continued reference to FIG. 3, the fixing device 20 is shown further including a sheet or media stripper 27 disposed downstream from the fixing nip N in the conveyance direction Y to define an elongated, longitudinal edge 27*a* extending in the axial direction X while positioned adjacent to and apart from the fuser belt 21 to separate the recording sheet S from the fuser belt 21 upon exit from the fixing nip N.

The sheet stripper 27 comprises an elongated structure formed of one or more pieces of material, with its longitudinal edge 27*a* formed in any suitable shape, including, for example, a straight linear edge, a curved edge, a serrated or stepped edge, or any combination thereof, to separate, or assist in separating, the recording sheet S from the fuser belt 21. The media stripper 27 may be hinged for rotation around its rotational axis extending in the axial direction X.

Additionally, an auxiliary sheet or media stripper 34 may be disposed downstream from the fixing nip N in the conveyance direction Y to define an elongated, longitudinal edge extending in the axial direction X while positioned adjacent to and apart from the pressure roller 31 to separate the recording sheet S from the pressure roller 31 upon exit from the fixing nip N.

The auxiliary sheet stripper 34 comprises an elongated guide plate with its longitudinal edge formed in any suitable shape to separate, or assist in separating, the recording sheet S from the pressure roller 31. Provision of the auxiliary media stripper 34 is effective particularly during duplex printing where the recording sheet S tends to wind around the pressure roller 31 due to adhesion of the toner image previously fixed on the first printed side of the recording sheet S.

Figure 8:
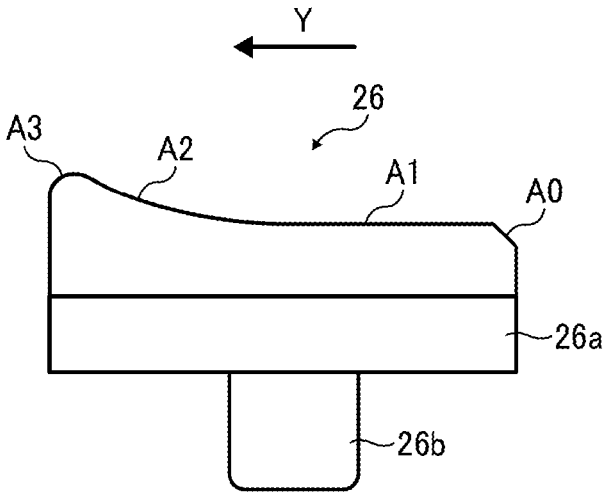
FIG. 8 is a side elevational view of the fuser pad of FIG. 6.

FIG. 8 is a side elevational view of the fuser pad 26.

As shown in FIG. 8, the fuser pad 26 includes an upstream section A1, a midstream section A2, and a downstream section A3 arranged in series from upstream to downstream in the conveyance direction Y, each of which defines a specially shaped surface for facing the pressure roller 31 upon assembly.

Figure 9:
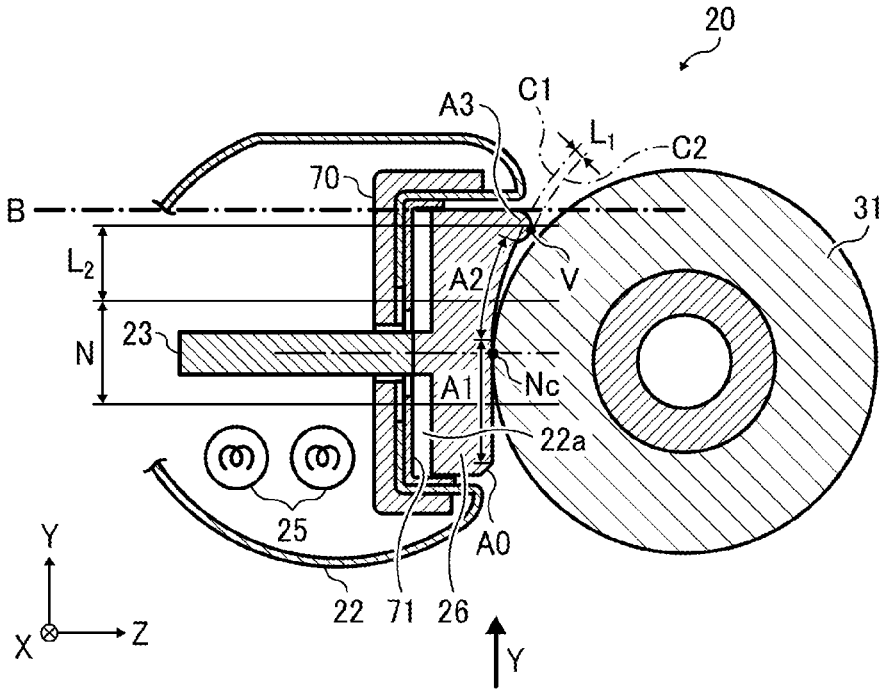
FIG. 9 is another end-on, axial view of the fixing device of FIG. 3, shown with a fuser belt omitted for clarity.

Specifically, with additional reference to FIG. 9, which is another end-on, axial view of the fixing device 20, shown with the fuser belt 21 omitted for clarity, the upstream section A1 defines a generally planar surface along which the recording medium S is introduced into the fixing nip N; the midstream section A2 defines an inwardly curved, concave surface that conforms to an outer circumferential surface of the pressure roller 31; and the downstream section A3 defines a protruding surface that protrudes outward toward the pressure roller 31 while located apart from the pressure roller 31.

Providing the fuser pad 26 with the differently shaped surfaces from upstream to downstream in the conveyance direction Y effectively prevents image defects due to insufficient heat and pressure through the fixing nip N, while allowing good separation of the recording medium S from the fuser belt 21.

In particular, provision of the downstream section A3 defining a protruding surface in combination with the midstream section A2 defining an inwardly curved, concave surface, as opposed to a flat, planar surface, results in a sufficiently small gap between the fuser belt 21 and the recording medium 5, translating into a sufficient heat and pressure applied to the recording medium S, even where the leading edge of the recording medium S reaches the protruding surface which would direct the outgoing sheet S away from the fuser belt 21 toward the pressure roller 31.

Moreover, deploying the protruding surface of the downstream section A3 apart from the pressure roller 31 prevents undesired winding or wrapping of the recording medium S around the pressure roller 31 as well as improper extension of the fixing nip N in the conveyance direction Y, which would occur where the protruding surface of the downstream section A3 accidentally contacts the pressure roller 31.

More specifically, in the present embodiment, the upstream section A1 extends over an area overlapping and immediately upstream from the fixing nip N. Upon entry into the fixing nip N after passing through the secondary transfer nip defined between the backup roller 82 and the secondary transfer roller 89, the recording sheet S conveyed along the generally planar surface of the upstream section A1 can maintain its generally flat, planar configuration without bending or deformation.

The midstream section A2 extends over an area overlapping and immediately downstream from the fixing nip N. With the inwardly curved, concave surface of the midstream section A2, the recording sheet S passing through the fixing nip N can closely contact the fuser belt 21 under pressure from the pressure roller 31.

The downstream section A3 extends over an area downstream from the fixing nip N. The protruding surface of the downstream section A3 causes the fuser belt 21 to assume a greater curvature at the exit of the fixing nip N than within the fixing nip N, which ensures the recording sheet S separates from the fuser belt 21 even in the presence of adhesion between fused toner and belt surfaces. Alternatively, instead of or in addition to facilitating sheet separation from the fuser belt 21, the protruding surface of the downstream section A3 may be configured to bend the recording sheet S away from the fuser belt 21 to prevent curling of the recording sheet S upon exit from the fixing nip N.

Further, in the present embodiment, a relieved edge A0, such as a chamfered or rounded edge, is provided immediately upstream from the upstream section A1 in the conveyance direction Y. For example, the relieved edge may be a chamfered edge that extends, for example, approximately 0.5 mm from the generally planar surface of the upstream section A1.

The relieved edge A0 of the fuser pad 26, together with the adjoining edge of the side slot 22*a* of the heat pipe 22, form a substantially continuous surface along which the fuser belt 21 smoothly passes from the heat pipe 22 to the fuser pad 26. Such arrangement prevents the fuser belt 21 from damage and premature failure due to bending upon contacting the fuser pad 26, while allowing the heat pipe 22 to reliably contact and slide against the fuser belt 21 to heat the belt 21 sufficiently immediately upstream from the fixing nip N, leading to high thermal efficiency in the belt-based fixing device 20.

For comparison purposes, consider a configuration in which the fuser pad 26 has a perpendicular edge, instead of a chamfered or rounded edge, adjoining the edge of the side slot 22*a* of the heat pipe 22. In such cases, presence of the perpendicular edge creates a gap or unevenness between the adjoining surfaces of the heat pipe 22 and the fuser pad 26, which cause the fuser belt 21 to bend and elevate away from contact with the heat pipe 22 upstream from the fixing nip N, resulting in damage and premature failure of the belt material as well as insufficient heating of the fuser belt 21 before entering the fixing nip N.

Furthermore, in the present embodiment, the inwardly curved, concave surface of the midstream section A2 has a constant radius of curvature ranging from approximately 25 mm to approximately 60 mm. For a good conformity between the adjoining surfaces of the midstream section A2 and the pressure roller 31, the radius of curvature may be adjusted depending on the diameter of the pressure roller 31. For example, where the diameter of the pressure roller 31 is set to 30 mm, the radius of curvature of the midstream section A2 is set to 60 mm.

The upstream end of the midstream section A2, coextensive with the downstream end of the upstream section A1, may be any point within the fixing nip N, which is determined with respect to a center Nc of the fixing nip N in the conveyance direction Y. In the present embodiment, the upstream end of the midstream section A2 is located downstream from the center Nc of the fixing nip N, so that the upstream section A1 encompasses a broader area within the fixing nip N than that of the midstream section A2.

Positioning of the upstream end of the midstream section A2 may be other than that described in FIG. 9, such as upstream from, or coincident with the center Nc of the fixing nip N, depending on the specific configuration.

Still further, in the present embodiment, the downstream section A3 is contiguous to, and immediately downstream from, the midstream section A2 in the conveyance direction Y. The protruding surface of the downstream section A3 may have a vertex V thereof lying on an imaginary curve C2 concentric to, and smaller in radius than, an imaginary curve C1 with which the inwardly curved surface of the midstream section A2 coincides.

In such cases, a distance $L_1$, in a radial direction of the imaginary curves C1 and C2, between the inwardly curved surface of the midstream section A2 and the vertex V of the downstream section A3 (i.e., a difference in radius between the imaginary curves C1 and C2) may fall within a range between approximately 0.1 mm to approximately 0.2 mm. In addition, a distance $L_2$, in the conveyance direction Y of the recording sheet S, between a downstream end of the fixing nip N and the vertex V of the downstream section A3 may fall within a range between approximately 1 mm to approximately 2 min.

Setting the distance $L_1$ between approximately 0.1 mm to approximately 0.2 mm and the distance $L_2$ between approximately 1 mm to approximately 2 mm allows for proper operation of the fixing device without causing variations in nip pressure or winding of recording medium around the fixing members.

For example, setting the distance $L_2$ below 1 mm can cause variations in pressure across the fixing nip N, in which interference between the downstream section A3 and the pressure roller 31 causes the midstream section A2 of the fuser pad 26 to partly come off the outer circumferential surface of the pressure roller 31, resulting in a locally reduced area of contact between the fuser pad 26 and the pressure roller 31 within the fixing nip N. Such variations in contact between the fixing members can translate into variations in pressure with which a toner image is processed through the fixing nip N, leading to concomitant print defects, such as orange-peel effects, in the resulting image.

Setting the distance $L_2$ above 2 mm and/or setting the distance $L_1$ above 0.2 mm can cause the recording sheet S to wind around the pressure roller 31, in which interference between the downstream section A3 and the recording sheet S causes the sheet S to bend and deflect away from the fuser pad 26 to eventually wrap around the outer circumferential surface of the pressure roller 31 upon exiting the fixing nip N.

This is particularly true during duplex printing, in which the recording sheet S enters the fixing nip N with a first, previously printed side facing the pressure roller 31 and a second, unfixed side facing the fuser belt 21, which causes toner once fixed on the first side to soften and become adhesive to the pressure roller 31 due to heat within the fixing nip N.

Setting the distance $L_1$ below 0.1 mm increases the risk of winding the recording sheet S around the fuser belt 21, in which the downstream section A3 fails to properly separate the recording sheet S from the fuser belt 21, causing the outgoing sheet S to eventually wrap around the circumferential surface of the belt 21 at the exit of the fixing nip N.

Thus, setting the distances $L_1$ and $L_2$ to the appropriate ranges prevents undue interference between the fuser pad 26 and the pressure roller 31 as well as between the recording sheet S and the fixing members, leading to reliable fixing performance of the fixing device 20.

Yet still further, in the present embodiment, the protruding surface of the downstream section A3 forms a circular arc in cross section. That is, the protruding surface may be an outwardly curved surface with a constant radius of curvature, which is tangent to both the imaginary curve C2 and an imaginary plane B passing through a downstream end of the fuser pad 26 and perpendicular to the conveyance direction Y. Such arrangement prevents the recording sheet S from excessively bending around the downstream section A3, and allows for ready separation of the recording sheet S from the fuser belt 21 upon exiting the fixing nip N.

Figure 10:
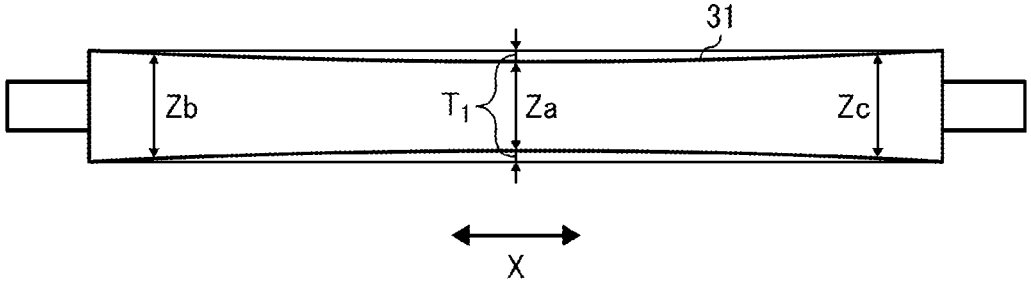
FIG. 10 is a schematic view of a pressure member before assembly into the fixing device of FIG. 3.

FIG. 10 is a schematic view of the pressure member 31 before assembly into the fixing device 20.

As shown in FIG. 10, the pressure member 31 comprises a concave roller whose diameter gradually increases by a first amount of taper $T_1$ from a longitudinal center toward both longitudinal ends thereof in the axial direction X.

The concave configuration of the pressure member 31 allows for equalizing temperature distribution in the longitudinal direction X across the fixing nip N, where heat dissipates to the air at the longitudinal edges of the concave roller 31, leading to stabilized performance of the fixing device.

Figure 11A:
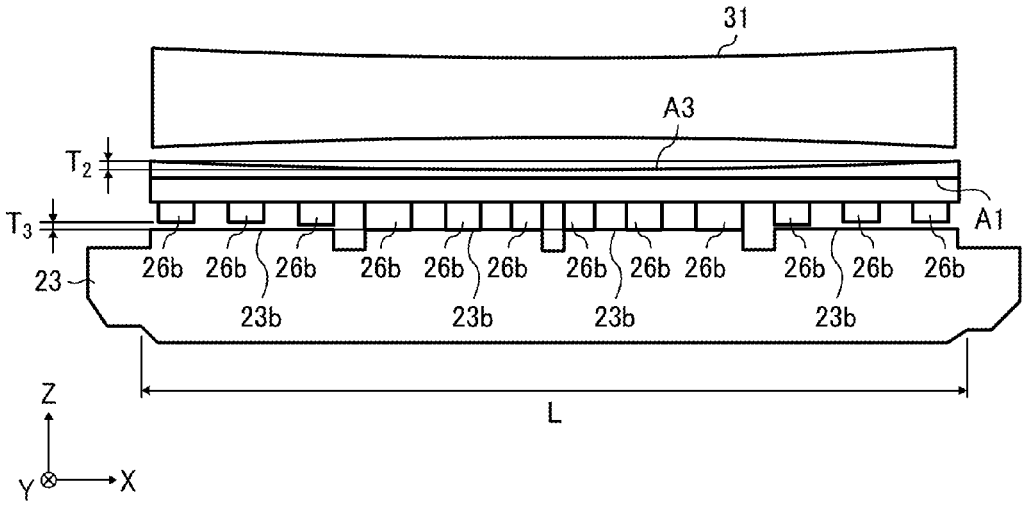
FIGS. 11A and 11B are elevational views of the fuser pad, the pressure member, and the reinforcing member, shown in their respective positions with the fuser belt omitted for clarity.
Figure 11B:
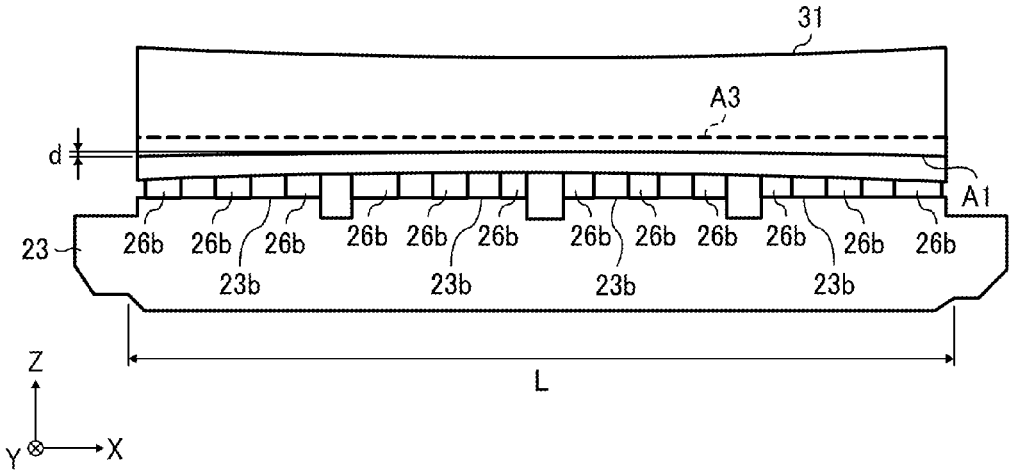

With additional reference to FIGS. 11A and 11B, the fuser pad 26, the pressure roller 31, and the reinforcing member 23 are shown in their respective positions with the fuser belt 21 omitted for clarity, where no pressure exists between the pressure roller 31 and the fuser pad 26 (FIG. 11A), and where the pressure roller 31 exerts pressure against the fuser pad 26 (FIG. 11B).

As shown in FIGS. 11A and 11B, the downstream section A3 of the fuser pad 26 has a thickness in the load direction Z which gradually increases by a second amount of taper corresponding to the first amount of taper $T_1$, from a longitudinal center toward both longitudinal ends thereof in the axial direction X.

As used herein, the term "taper" refers to a gradual increase in length or thickness in the load direction Z from a longitudinal center toward opposed longitudinal ends of an elongated structure extending in the axial direction X, such as the pressure member 31 and the fuser pad 26. For example, such tapering may be provided symmetrically with respect to the longitudinal center of the elongated structure. The term "amount of taper" refers to a difference in length or thickness in the load direction Z between the longitudinal center and longitudinal end of the tapered, elongated structure. Additionally, the term "longitudinal center" is used to describe a central portion generally equidistant from opposed extreme edges of the elongated structure, which includes, but is not limited to, the precise longitudinal center of the elongated structure. The term "longitudinal end" is used to describe an end portion extending from one extreme edge of the elongated structure, which includes, but is not limited to, the precise longitudinal end of the elongated structure.

In the present embodiment, the first amount of taper may be defined, for example, as a difference between an average of diameters at the longitudinal ends and a diameter at the longitudinal center of the pressure member across a given width, as given by the following equation:

$$T_1=(Zb+Zc)/2-Za \qquad \text{Equation I}$$

where "$T_1$" is the first amount of taper in mm, "Za" is the roller diameter in mm at the longitudinal center, "Zb" is the roller diameter in mm at one longitudinal end, and "Zc" is the roller diameter at the other longitudinal end.

The width across which the roller diameters are measured may be defined as the total of a maximum width of recording medium accommodated in the fixing device and a given additional width of, for example, 10 mm (5 mm each side).

The inventor has recognized that one problem encountered when employing a concave pressure roller in combination with a fuser pad that has an integral, protruding surface at a downstream section thereof for facilitating separation of the recording medium and/or for correcting curl on the recording medium is malfunction of the media stripper downstream from the fixing nip due to deformation of the fuser pad under pressure from the pressure roller.

Figure 12:
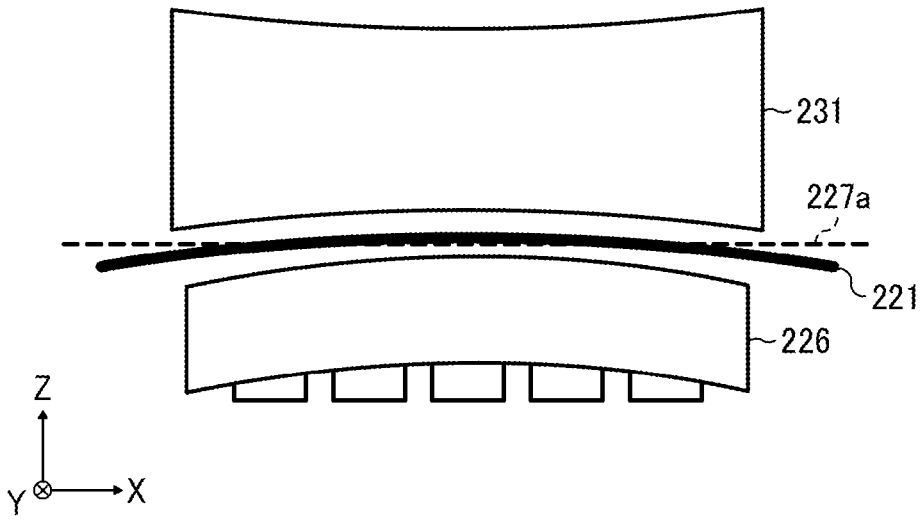
FIG. 12 is a schematic view of an exemplary fixing device.

With reference to FIG. 12, an exemplary fixing device is shown including a fuser pad 226 and a concave pressure roller 231 pressing against the fuser pad 226 via a fuser belt 221 to form a fixing nip therebetween through which a recording sheet is conveyed, as well as a sheet stripper defining a longitudinal edge 227*a* for separating the sheet from the fuser belt 221 downstream from the fixing nip.

As shown in FIG. 12, the fuser pad 226 bends or deforms under pressure form the concave pressure roller 231, causing the fuser belt 121 to assume a convex shape curving away from the axial, longitudinal direction of the fuser pad 226.

On one hand, deformation of the fuser pad 226 allows the fuser belt 221 to contact the pressure roller 231 closely and uniformly across the fixing nip. Uniform contact between the fuser belt 221 and the pressure roller 231 translates into uniform, sufficient heat and pressure applied to the recording sheet through the fixing nip, leading to stable fixing and glossing performance of the fixing device.

On the other hand, however, the fuser pad 226 thus deformed does not properly align with the longitudinal edge 227*a* of the sheet stripper, which is normally designed to extend in the longitudinal direction of the fuser pad 226. Misalignment between the fuser pad 226 and the sheet stripper edge 227*a* results in different sizes of gap by which the recording sheet is spaced apart from the adjoining surfaces of the fuser belt and the sheet stripper, making it difficult for the sheet stripper edge 227*a* to properly engage the recording sheet for stripping it away from the fuser belt 221.

These and other problems are effectively addressed by the fixing device 20 according to this patent specification, owing to provision of the downstream section A3 of the fuser pad 26 which is tapered in the axial direction X by an amount corresponding to that of the concave pressure roller 31.

Specifically, in the present embodiment, the downstream section A3 of the fuser pad 26 is concave away from the pressure member 31 in its original, unloaded state (FIG. 11A), and is flat facing the pressure member 31 in its operational, loaded state (FIG. 11B).

As used herein, the term "unloaded state" refers to an original condition or shape assumed where the fuser pad 26 is free from pressure from the pressure member 31. The term "loaded state" refers to an operational condition or shape assumed where the fuser pad 26 is subjected to pressure from the pressure member 31.

Figure 13:
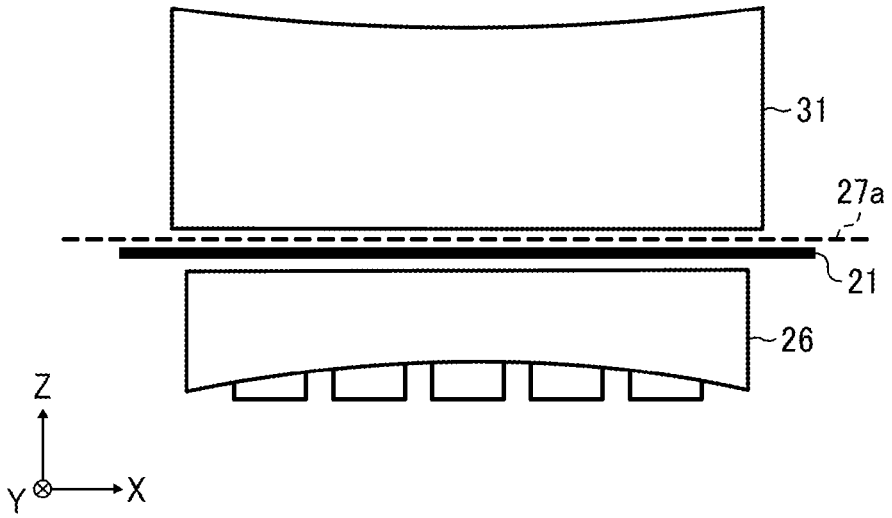
FIG. 13 is a schematic view of the fixing device according to one or more embodiments of this patent specification.

As mentioned earlier, the fixing device 20 in the present embodiment is provided with the sheet or media stripper 27 disposed downstream from the fixing nip N in the conveyance direction Y to define an elongated, longitudinal edge 27*a* extending in the axial direction X while positioned adjacent to and apart from the fuser belt 21 to separate the recording medium S from the fuser belt 21 upon exit from the fixing nip N. In such cases, the downstream section A3 of the fuser pad 26, in its operational, loaded state, generally parallels the longitudinal edge 27*a* of the media stripper 27, as shown in FIG. 13.

Thus, in the fixing device 20, tapering the downstream section A3 of the fuser pad 26 in its original, unloaded state enables the downstream section A3 in its operational, loaded state to align with the longitudinal edge 27*a* of the sheet stripper 27 extending in the longitudinal direction X of the fuser pad 26. Proper alignment between the downstream section A3 of the fuser pad 26 and the sheet stripper edge 27*a* results in a uniform size of gap by which the recording sheet S is spaced apart from the adjoining surfaces of the fuser belt 21 and the sheet stripper 27, which ensures the sheet stripper edge 27*a* properly engages the recording sheet S for stripping it away from the fuser belt 21.

With continued reference to FIGS. 11A and 11B, the fixing device 20 in the present embodiment is shown provided with the one or more support projections 26*b* integrally disposed on the fuser pad 26 on a side opposite that facing the pressure member 31 to reinforce the fuser pad 26 in the load direction Z. In the present embodiment, the support projections 26*b* comprise a plurality of separate projections arranged in series in the axial direction X. Alternatively, instead, the support projections 26*b* may be configured as a single elongated continuous projection extending in the axial direction X.

As shown in FIGS. 11A and 11B, the support projections 26*b* of the fuse pad 26 have a thickness in the load direction Z which gradually increases by a third amount of taper $T_3$, corresponding to the first amount of taper $T_1$, from both longitudinal ends toward a longitudinal center thereof in the axial direction X.

In such a configuration, the support projections 26*b*, when subjected to pressure from the pressure roller 31, become flush against the contact portions 23*b* of the reinforcing member 23, while thrusting toward the pressure roller 31 deeper at the longitudinal center than at the longitudinal ends thereof, allowing the downstream section A3 of the fuser pad 26 to be flat facing the pressure roller 31 in its operational, loaded state.

More specifically, in the present embodiment, the third amount of taper is given by the following equation:

$$T_3=T_1+k/L \qquad \text{Equation II}$$

where "$T_1$" is the first amount of taper, "$T_3$" is the third amount of taper, "L" is a length of the fuser pad in the axial direction X, and "k" is an adjustable value approximately half a maximum width of the recording medium S.

The length L of the fuser pad 26 may be equal to that of the reinforcing member 23. The variable k may be adjusted depending on a specific configuration of the fixing device 20, such as material of the stay.

Further, the second amount of taper is given by the following equation:

$$T_2=T_3+0.2 \qquad \text{Equation III}$$

where "$T_2$" is the second amount of taper in mm, and "$T_3$" is the third amount of taper in mm.

In the present embodiment, the first amount of taper $T_1$ is in the range of 0.1 to 0.2 mm, the fuser pad has a length L of 350 mm in the axial direction, and the constant variable k is set to 140 where the maximum width of recording medium is 297 mm corresponding to the longer edge of A4 size paper. Substituting these values $T_1$, L, and k into Equations II and III gives the second amount of taper $T_2$ ranging from 0.5 to 0.6 mm, and the amount of taper $T_3$ ranging from 0.3 to 0.4 mm, respectively.

In further embodiment, at least one of the upstream and midstream sections A1 and A2 of the fuser pad 26 may have a thickness in the load direction Z which gradually increases by the second amount of taper $T_2$ from a longitudinal center toward both longitudinal ends thereof in the axial direction X.

For example, the midstream section A2 of the fuser pad 26 may have a thickness in the load direction which gradually increases by the second amount of taper $T_2$ from a longitudinal center toward both longitudinal ends thereof in the axial direction X. The midstream section A2 of the fuser pad 26 may be concave away from the pressure member 31 in its original, unloaded state, and flat facing the pressure member 31 in its operational, loaded state. In such cases, the midstream section A2 of the fuser pad 26 generally parallels the longitudinal edge of the media stripper in its operational, loaded state.

Note that, in contrast to the midstream and downstream sections A2 and A3, the upstream section A1 of the fuser pad 26, which has a generally uniform thickness in the load direction throughout an entire length of the fuser pad 26 in the axial direction X, is convex toward the pressure member 31 in its operational, loaded state, with an offset or difference d in position in the load direction Z between the longitudinal center and the longitudinal ends thereof, as shown in FIG. 11B.

Compared to a configuration in which tapering is provided only to the downstream section A3, tapering each of the midstream and downstream sections A2 and A3 of the fuser pad 26 to generally parallel the longitudinal edge 27*a* of the sheet stripper 27 in its operational, loaded state more reliably ensures that the recording sheet S is positioned in parallel alignment with the longitudinal edge 27*a* of the sheet stripper 27, leading to more effective sheet stripping performance.

Also, with the upstream section A1 of the fuser pad 26 being convex toward the pressure member 31 in its operational, loaded state, the fuser belt 21 and the pressure member 31 can closely and uniformly contact each other across the fixing nip N, which translates into uniform, sufficient heat and pressure applied to the recording sheet S through the fixing nip N, leading to stable fixing and glossing performance of the fixing device 20.

Hence, the fixing device 20 according to this patent specification provides stable fixing and glossing performance while effectively addressing problems encountered when employing a concave pressure roller in combination with a fuser pad that has an integral, protruding surface at a downstream section thereof for facilitating separation of the recording medium and/or for correcting curl on the recording medium.

In particular, malfunction of the sheet stripper downstream from the fixing nip due to deformation of the fuser pad under pressure from the pressure roller is effectively prevented, wherein tapering the downstream section A3 of the fuser pad 26 in the axial direction X by an amount corresponding to that of the concave pressure roller 31 allows for good alignment between the fuser pad 26 and the sheet stripper edge 27*a* downstream from the fixing nip N without compromising uniform contact between the fuser belt 21 and the pressure roller 31 within the fixing nip N.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotatable, flexible fuser belt looped into a generally cylindrical configuration;

a fuser pad extending in an axial, longitudinal direction thereof inside the loop of the fuser belt; and a pressure member extending in the axial direction opposite the fuser pad with the fuser belt interposed between the fuser pad and the pressure member, the pressure member pressing against the fuser pad through the fuser belt in a load direction to form a fixing nip therebetween, through which a recording medium is conveyed in a conveyance direction, the fuser pad including an upstream section, a midstream section, and a downstream section arranged in series from upstream to downstream in the conveyance direction, the upstream section defining a generally planar surface along which the recording medium is introduced into the fixing nip, a portion of the upstream section being located apart from the pressure member, the downstream section defining a protruding surface that protrudes outward toward the pressure member while located apart from the pressure member, wherein the pressure member comprises a concave roller whose diameter gradually increases by a first amount of taper from a longitudinal center toward both longitudinal ends thereof in the axial direction, the downstream section of the fuser pad has a thickness in the load direction which gradually increases by a second amount of taper, corresponding to the first amount of taper, from a longitudinal center toward both longitudinal ends thereof in the axial direction, one or more support projections integrally disposed on the fuser pad on a side opposite that facing the pressure member to reinforce the fuser pad in the load direction, and the support projections having a thickness in the load direction which gradually increases by a third amount of taper, corresponding to the first amount of taper, from both longitudinal ends toward a longitudinal center thereof in the axial direction.

2. The fixing device according to claim 1, wherein the downstream section of the fuser pad is concave away from the pressure member in its original, unloaded state, and is flat facing the pressure member in its operational, loaded state.

3. The fixing device according to claim 1, further comprising:

a media stripper disposed downstream from the fixing nip in the conveyance direction to define an elongated, longitudinal edge extending in the axial direction while positioned adjacent to and apart from the fuser belt to separate the recording medium from the fuser belt upon exit from the fixing nip, wherein the downstream section of the fuser pad generally parallels the longitudinal edge of the media stripper in its operational, loaded state.

4. The fixing device according to claim 1, wherein the third amount of taper is given by the following equation:

$$T_3=T_1+k/L$$

where "$T_1$" is the first amount of taper in mm, "$T^3$" is the third amount of taper in mm, "L" is a length of the fuser pad in the axial direction, and "k" is an adjustable value approximately half a maximum width of the recording medium.

5. The fixing device according to claim 4, wherein the second amount of taper is given by the following equation:

$$T_2=T_3+0.2$$

where "$T_2$" is the second amount of taper in mm, and "$T_3$" is the third amount of taper in mm.

6. The fixing device according to claim 1, wherein at least one of the upstream and midstream sections of the fuser pad has a thickness in the load direction which gradually increases by the second amount of taper from a longitudinal center toward both longitudinal ends thereof in the axial direction.

7. The fixing device according to claim 6, wherein the at least one of the upstream and midstream sections of the fuser pad is concave away from the pressure member in its original, unloaded state, and is flat facing the pressure member in its operational, loaded state.

8. The fixing device according to claim 6, further comprising:

a media stripper disposed downstream from the fixing nip in the conveyance direction to define an elongated, longitudinal edge extending in the axial direction while positioned adjacent to and apart from the fuser belt to separate the recording medium from the fuser belt upon exit from the fixing nip, wherein the at least one of the upstream and midstream sections of the fuser pad generally parallels the longitudinal edge of the media stripper in its operational, loaded state.

9. The fixing device according to claim 1, wherein the downstream section of the fuser pad is contiguous to, and immediately downstream from, the midstream section of the fuser pad in the conveyance direction.

10. The fixing device according to claim 1, wherein the protruding surface of the downstream section forms a circular arc in cross section.

11. The fixing device according to claim 1, wherein the inwardly curved surface of the midstream section exhibits a constant radius of curvature ranging from approximately 25 millimeters to approximately 60 millimeters.

12. The fixing device according to claim 1, wherein the protruding surface of the downstream section has a vertex thereof lying on an imaginary curve concentric to, and smaller in radius than, an imaginary curve with which the inwardly curved surface of the midstream section coincides.

13. The fixing device according to claim 12, wherein a distance, in a radial direction of the imaginary curves, between the inwardly curved surface of the midstream section and the vertex of the downstream section falls within a range between approximately 0.1 mm to approximately 0.2 mm.

14. The fixing device according to claim 12, wherein a distance, in the conveyance direction of the recording medium, between a downstream end of the fixing nip and the vertex of the downstream section falls within a range between approximately 1 mm to approximately 2 mm.

15. The fixing device according to claim 1, wherein the fuser belt is formed of a substrate of nickel or stainless steel.

16. An image forming apparatus incorporating the fixing device according to claim 1.

17. The fixing device according to claim 1, wherein the midstream section has a constant radius of curvature defining an inwardly curved concave surface that conforms to an outer circumferential surface of the pressure member.

* * * * *